US007550035B1

(12) United States Patent
Heckel et al.

(10) Patent No.: US 7,550,035 B1
(45) Date of Patent: Jun. 23, 2009

(54) ELECTROSTATIC PRECIPITATOR WITH INERTIAL GAS-CONTAMINANT IMPACTOR SEPARATOR

(75) Inventors: Scott P. Heckel, Stoughton, WI (US); Gregory W. Hoverson, Cookeville, TN (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 0 days.

(21) Appl. No.: 11/749,267

(22) Filed: May 16, 2007

(51) Int. Cl.
*B03C 3/011* (2006.01)

(52) U.S. Cl. ..... 96/57; 55/462; 55/465; 55/DIG. 19; 95/32; 95/69; 95/78; 96/60; 96/97

(58) Field of Classification Search ..... 96/57, 96/60, 97; 55/462, 465, DIG. 17, DIG. 19; 95/32, 69, 78
See application file for complete search history.

(56) References Cited

U.S. PATENT DOCUMENTS

| | | | | |
|---|---|---|---|---|
| 5,564,401 | A | 10/1996 | Dickson | |
| 6,221,136 | B1 | 4/2001 | Liu et al. | |
| 6,247,463 | B1 | 6/2001 | Fedorowicz et al. | |
| 6,279,556 | B1 | 8/2001 | Busen et al. | |
| 6,290,738 | B1 | 9/2001 | Holm | |
| 6,354,283 | B1 | 3/2002 | Hawkins et al. | |
| 6,364,941 | B2 * | 4/2002 | Liu et al. | 96/60 |
| 6,478,019 | B2 | 11/2002 | Fedorowicz et al. | |
| 6,505,615 | B2 | 1/2003 | Pietschner | |
| 6,576,045 | B2 | 6/2003 | Liu et al. | |
| 6,589,314 | B1 * | 7/2003 | Page et al. | 95/32 |
| 6,626,163 | B1 | 9/2003 | Busen et al. | |
| 6,684,864 | B1 | 2/2004 | Busen et al. | |
| 6,827,761 | B2 * | 12/2004 | Graham | 95/32 |
| 6,902,604 | B2 | 6/2005 | Heckel et al. | |
| 6,994,076 | B2 | 2/2006 | Heckel et al. | |
| 7,082,897 | B2 | 8/2006 | Heckel et al. | |
| 7,112,236 | B2 | 9/2006 | Hoverson et al. | |
| 7,156,901 | B2 | 1/2007 | Hallgren et al. | |
| 7,158,589 | B2 | 1/2007 | Cameron et al. | |
| 2005/0223893 | A1 * | 10/2005 | Hoverson et al. | 95/57 |

FOREIGN PATENT DOCUMENTS

WO WO-2005/119020 12/2005

* cited by examiner

*Primary Examiner*—Richard L Chiesa
(74) *Attorney, Agent, or Firm*—Andrus, Sceales, Starke & Sawall, LLP; J. Bruce Schelkopf

(57) ABSTRACT

An electrostatic precipitator includes an inertial gas-contaminant impactor separator providing two stage separation and reducing contaminant collection load on the collector electrode at the corona discharge zone to reduce contaminant build-up thereon and extend service intervals for cleaning or replacement thereof.

14 Claims, 1 Drawing Sheet

ELECTROSTATIC PRECIPITATOR WITH INERTIAL GAS-CONTAMINANT IMPACTOR SEPARATOR

BACKGROUND AND SUMMARY

The invention relates to electrostatic precipitators or collectors, including for use in internal combustion engine electrostatic crankcase ventilation system, including for diesel engines.

Electrostatic precipitators or collectors, also known as electrostatic droplet collectors, are known in the prior art. In its simplest form, a high voltage corona discharge electrode is placed in proximity to a collector electrode, for example a high voltage corona discharge electrode is placed in the center of a grounded canister or tube forming an annular ground plane providing a collector electrode around the discharge electrode. A high DC voltage, such as several thousand, e.g. 15 kilovolts (kV), on the center discharge electrode causes a corona discharge to develop near the electrode due to high electric field intensity. This creates charge carriers that cause ionization of the gas in the gap between the high voltage electrode and the ground collector electrode. As the gas containing suspended contaminant particles flows through this region, the contaminant particles are electrically charged by the ions. The charged contaminant particles are then precipitated electrostatically by the electric field onto the interior surface of the ground electrode collecting tube or canister. Examples are shown in the following U.S. patents, incorporated herein by reference: U.S. Pat Nos. 6,902,604; 6,994,076; 7,082,897; 7,112,236.

Electrostatic precipitators have been used in diesel engine crankcase ventilation systems for removing suspended particulate contaminant matter including oil droplets from blowby gas, for example so that the blowby gas can be returned to the atmosphere (OCV, open crankcase ventilation system), or to the fresh air intake side of the diesel engine for further combustion (CCV, closed crankcase ventilation system) thus providing a blowby gas recirculation system. Electrostatic precipitators are also used in other internal combustion engine electrostatic crankcase ventilation systems for receiving recirculation gas from the engine, and returning cleaned gas to the engine. Electrostatic precipitators are also used in other applications, e.g., oil mist recirculation in a compressor, and various other applications for collecting contaminant particulate ionized in an electric field created by a high voltage corona discharge electrode.

A corona discharge electrode assembly commonly used in the prior art has a holder or bobbin with a 0.006 inch diameter wire strung in a diagonal direction. The bobbin is provided by a central drum extending along an axis and having a pair of annular flanges axially spaced along the drum and extending radially outwardly therefrom. The wire is a continuous member strung back and forth between the annular flanges to provide a plurality of segments supported by and extending between the annular flanges and strung axially and partially spirally diagonally between the flanges.

When an electrostatic precipitator is in service on a diesel engine, a build-up of sludge often occurs on the grounded electrode, e.g. the annular ground plane provided by the canister. This sludge build-up can cause a degradation of the performance of the precipitator, and increases the frequency of sparking between the corona discharge electrode and the grounded electrode. The rate of build-up is exacerbated by the sparking, and in turn the sparking increases with the build-up of such material. Eventually, the efficiency of the precipitator decreases due to high frequency (e.g. 400 Hz or greater) sparking and other unstable events which can last for a duration on the order of a minute. In addition to causing a decrease in efficiency, the sparking causes stress on electrical components including the power supply due to the discharge/charge process of sparking. This is problematic in automotive applications which require long service life, or at least extended intervals between servicing, which has limited the application of this technology.

One solution to the noted problem is to periodically clean the collector electrode to remove the build-up therefrom, e.g. by impact or vibration which may be mechanically induced, e.g. mechanical rapping, or by acoustical vibration. This is not satisfactory in the case of crankcase blowby because the particles are liquid, and the build-up is sticky, particularly in the presence of sparking.

Another solution known in the prior art is to clean the electrode by a mechanical wiper automatically during operation. This is undesirable because it requires mechanical parts subject to failure, and increases cost by adding components.

The noted U.S. Pat. No. 6,994,076 provides a solution where the electrostatic precipitator or droplet collector is provided with a replaceable electrode assembly which is connectable and removable in a simple servicing step enabling and facilitating replacement at regular service intervals. In preferred form, part of the precipitator is permanent and remains attached to the engine or an underhood mounting location, and only low cost items are replaced. The ease of servicing promotes periodic replacement, thus avoiding the noted degradation of performance. In further preferred form, then electrode assembly is replaced in a simple spin-on, spin-off step comparable to replacing an oil filter. This familiarity is considered desirable to encourage maintenance at recommended intervals by service personnel, without having to learn unfamiliar service procedures. In one embodiment, both the collector electrode and the corona discharge electrode are removed as a unit from a mounting head in the system. In another embodiment, only the collector electrode is removed.

The present invention provides a further solution, and enables extended service intervals, improved electrostatic precipitator performance, extended service life, and reduced energy usage.

Inertial gas-contaminant, including gas-liquid, impactor separators are known in the prior art. Contaminant is removed from a gas-contaminant stream by accelerating the stream to high velocities through holes or nozzles and directing same against an inertial impactor collector in the path of the accelerated gas-contaminant stream and causing the accelerated stream to follow a sharp directional change, effecting contaminant separation. These types of inertial impactors are typically used as measurement devices to classify and determine concentration and size distribution of aerosol particles, e.g. in a gas-liquid stream. Such inertial impactor collectors have also been used in contaminant separation applications including oil separation for blowby gases from the crankcase of an internal combustion engine. Examples are shown in the following U.S. patents, incorporated herein by reference: U.S. Pat. Nos. 6,290,738; 6,354,283; 6,478,019; 6,576,045.

The present invention arose during continuing development efforts directed toward the above technologies, and provides a desirable combination thereof.

DETAILED DESCRIPTION

Figure 1:
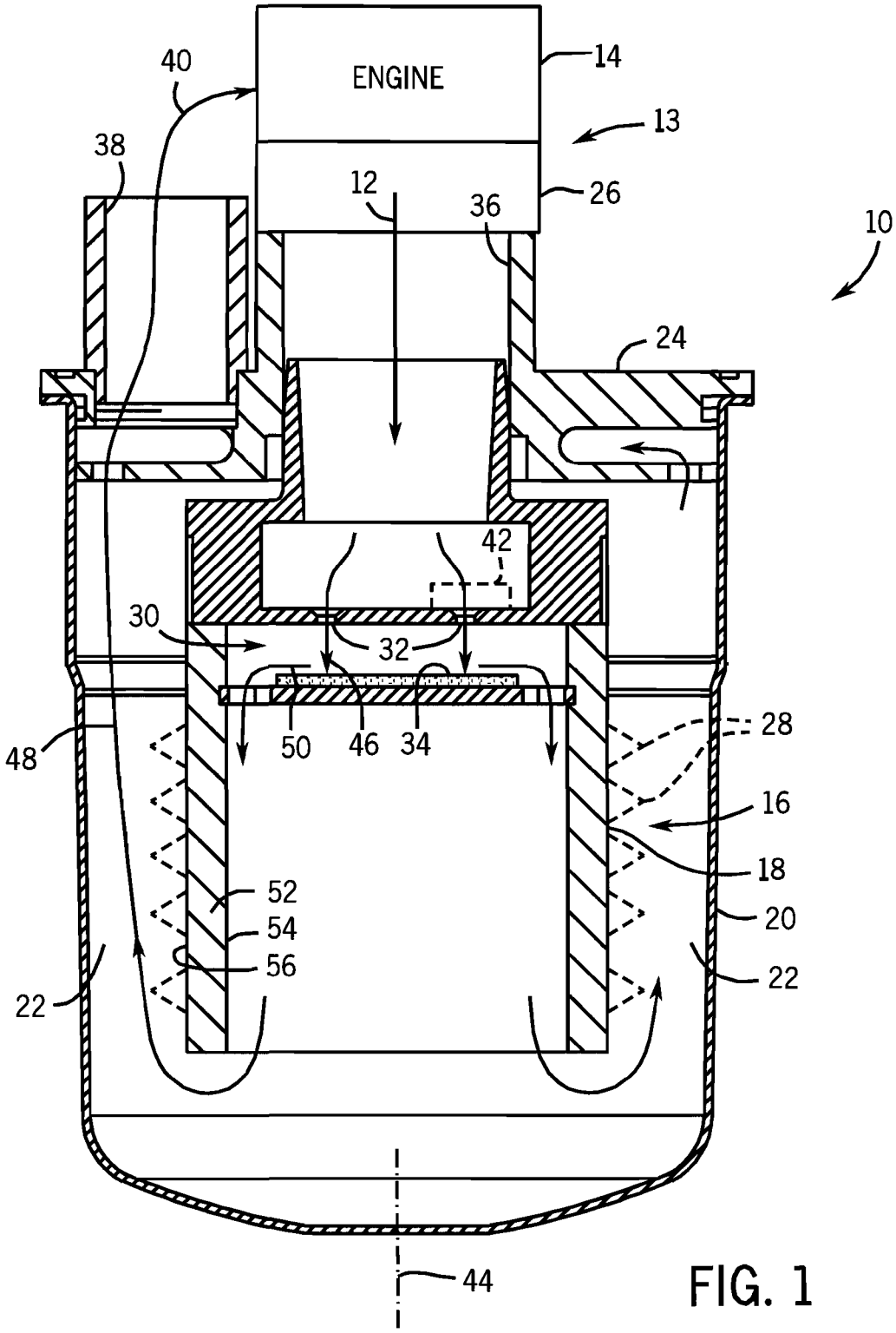
FIG. 1 is a schematic sectional view of an electrostatic precipitator in accordance with the invention.

FIG. 1 shows an electrostatic precipitator 10 for cleaning a gas flowing therethrough from upstream to downstream as shown at the flow arrows, namely by removing contaminant from a gas-contaminant stream 12, e.g. blowby gas in a crankcase ventilation system 13 of an internal combustion engine 14. An electrode assembly 16 includes a corona discharge electrode 18 and a collector electrode 20 defining a corona discharge zone 22 therebetween precipitating contaminant from the gas. The electrode assembly may be like that shown in the above-noted incorporated U.S. patents, for example with collector electrode 20 being a ground electrode provided by a canister mounted at lid 24 to a mounting head 26 of the internal combustion engine crankcase ventilation system, as in incorporated U.S. Pat. Nos. 6,994,076, 7,082,897 and 7,112,236, and with the corona discharge electrode 18 provided with corona discharge tips such as 28 like discharge tips 76 in the incorporated '236 patent for improved and focused corona discharge performance.

An inertial gas-contaminant impactor separator 30 is provided in series with corona discharge zone 22 and removes contaminant from the gas-contaminant stream 12. The inertial gas-contaminant impactor separator includes one or more nozzles 32 accelerating the gas-contaminant stream therethrough, and includes an inertial impactor collector 34 in the path of the accelerated gas-contaminant stream and causing contaminant particle separation from the gas-contaminant stream, for example as in incorporated U.S. Pat. No. 6,290,738.

Collector electrode 20 collects contaminant precipitated in corona discharge zone 22, and is subject to contaminant build-up requiring cleaning or replacement at periodic service intervals. Gas-contaminant impactor separator 30 is upstream of corona discharge zone 22 and pre-separates and collects some of the contaminant prior to reaching corona discharge zone 22, to reduce contaminant collection load on collector electrode 20 to thus reduce contaminant build-up thereon and extend the service interval for cleaning or replacement thereof. In the preferred embodiment, the collector electrode is a ground electrode provided by the noted canister 20, and corona discharge electrode 18 is in canister 20 and spaced therefrom by gap 22 providing the noted corona discharge zone. Canister 20 is closed by lid 24 which has an inlet 36 receiving gas-contaminant stream 12, e.g. blowby gas from engine 14, and has an outlet 38 discharging cleaned gas at 40 from corona discharge zone 22. Inertial gas-contaminant impactor separator 30 is in canister 20 downstream of inlet 36 and upstream of corona discharge zone 22. In one embodiment, inertial gas-contaminant impactor separator 30 may include a variable flow controller 42, for example as shown in the following incorporated commonly owned co-pending U.S. patent applications: application Ser. No. 10/946,603, filed Sep. 21, 2004; application Ser. No. 11/168,688, filed Jun. 28, 2005; application Ser. No. 11/622,051 filed Jan. 11, 2007. The variable flow controller controls flow against inertial impactor collector 34 in response to a given parameter, for example a parameter of the engine, or pressure of the blowby gas. The crankcase ventilation system may be a closed crankcase ventilation (CCV) system, as shown, or may be an open crankcase ventilation (OCV) system where clean gas 40 is returned to the atmosphere rather than to engine 14.

Electrode assembly 16 and inertial gas-contaminant impactor separator 30 are mounted in a common housing 20, 24, with each of the electrode assembly and the inertial gas-contaminant impactor separator being interiorly disposed within the same such common housing. The housing extends along an axial direction 44. Nozzles 32 accelerate the gas-contaminant stream axially therethrough as shown at 46. Corona discharge zone 22 conducts gas axially therethrough as shown at 48. Nozzles 32 accelerate the gas-contaminant stream axially therethrough along a first axial flow path at 46 along a first axial direction (downwardly in FIG. 1). Corona discharge zone 22 conducts gas axially therethrough along a second axial flow patch at 48 along a second axial direction (upwardly in FIG. 1). The noted first and second axial directions, downwardly and upwardly, respectively, are opposite to each other. The noted second axial flow path at 48 is spaced laterally outwardly of the noted first axial flow path at 46. The gas-contaminant stream accelerated along the first axial flow path at 46 strikes inertial impactor collector 34 and flows along a lateral flow path at 50 laterally outwardly in a direction towards corona discharge zone 22 and the noted second axial flow path at 48. Electrode 18 includes an axially extending wall 52 separating and extending axially between lateral flow path 50 and second axial flow path 48. Wall 52 has a first wall surface 54 laterally facing lateral flow path 50, and has a second wall surface 56 laterally facing second axial flow path 48. The gas flows laterally along lateral flow path 50 then axially in the first axial direction (downwardly) along first wall surface 54 then around the bottom end of wall 52 then axially in the second axial direction (upwardly) along second wall surface 56.

In an alternative embodiment, an inertial impactor separator which is external of the housing may additionally or alternatively be used.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An electrostatic precipitator for cleaning a gas flowing therethrough from upstream to downstream, by removing contaminant from a gas-contaminant stream, comprising an electrode assembly comprising a corona discharge electrode and a collector electrode defining a corona discharge zone therebetween precipitating contaminant from said gas, and an inertial gas-contaminant impactor separator in series with said corona discharge zone and removing contaminant from said gas-contaminant stream, said inertial gas-contaminant impactor separator comprising a nozzle accelerating said gas-contaminant stream therethrough, and an inertial impactor collector in the path of said accelerated gas-contaminant stream and causing contaminant particle separation from said gas-contaminant stream.

2. The electrostatic precipitator according to claim 1 wherein said collector electrode collects contaminant precipitated in said corona discharge zone and is subject to contaminant build-up requiring cleaning or replacement at periodic service intervals, and wherein said gas-contaminant impactor separator is upstream of said corona discharge zone and pre-separates and collects some of said contaminant prior to reaching said corona discharge zone, to reduce contaminant collection load on said collector electrode to thus reduce contaminant build-up thereon and extend the service interval for cleaning or replacement thereof.

3. The electrostatic precipitator according to claim 2 wherein said gas is blowby gas in an internal combustion engine crankcase ventilation system, said collector electrode comprises a canister mounted to a mounting head in said system, said corona discharge electrode is in said canister and spaced therefrom by a gap providing said corona discharge zone.

4. The electrostatic precipitator according to claim 3 wherein said canister is closed by a lid, said lid having an inlet receiving said gas-contaminant stream, comprising said blowby gas from said engine, said lid having an outlet discharging cleaned gas from said corona discharge zone, and wherein said inertial gas-contaminant impactor separator is in said canister downstream of said inlet and upstream of said corona discharge zone.

5. The electrostatic precipitator according to claim 4 wherein said inertial gas-contaminant impactor separator includes a variable flow controller controlling flow against said inertial impactor collector in response to a given parameter.

6. The electrostatic precipitator according to claim 5 wherein said given parameter is selected from the group consisting of:

a) a designated parameter of said engine; and b) pressure of said blowby gas.

7. The electrostatic precipitator according to claim 4 wherein said crankcase ventilation system is selected from the group consisting of:

a) a closed crankcase ventilation (CCV) system; and b) an open crankcase ventilation (OCV) system.

8. The electrostatic precipitator according to claim 2 wherein said electrode assembly and said inertial gas-contaminant impactor separator are mounted in a common housing, each of said electrode assembly and said inertial gas-contaminant impactor separator being interiorly disposed within the same said common housing.

9. The electrostatic precipitator according to claim 8 wherein said housing extends along an axial direction, said nozzle accelerates said gas-contaminant stream axially therethrough, and said corona discharge zone conducts gas axially therethrough.

10. The electrostatic precipitator according to claim 9 wherein said nozzle accelerates said gas-contaminant stream axially therethrough along a first axial flow path along a first axial direction, said corona discharge zone conducts gas axially therethrough along a second axial flow path along a second axial direction, wherein said first and second axial directions are opposite to each other.

11. The electrostatic precipitator according to claim 10 wherein said second axial flow path is spaced laterally outwardly of said first axial flow path.

12. The electrostatic precipitator according to claim 11 wherein said gas-contaminant stream accelerated along said first axial flow path strikes said inertial impactor collector and flows along a lateral flow path laterally outwardly in a direction towards said corona discharge zone and said second axial flow path.

13. The electrostatic precipitator according to claim 12 comprising an axially extending wall separating and extending axially between said lateral flow path and said second axial flow path, said wall having a first wall surface laterally facing said lateral flow path, and a second wall surface laterally facing said second axial flow path, such that gas flows laterally along said lateral flow path then axially in said first axial direction along said first wall surface then axially in said second axial direction along said second wall surface.

14. The electrostatic precipitator according to claim 1 wherein said inertial impactor collector is a physical inertial impactor collector.

* * * * *